US007005786B2

(12) United States Patent
In et al.

(10) Patent No.: US 7,005,786 B2
(45) **Date of Patent: *Feb. 28, 2006**

(54) MASK FRAME ASSEMBLY HAVING THERMAL CORRECTION UNIT AND COLOR CRT USING THE SAME

(75) Inventors: Jun-kyo In, Suwon (KR); Dong-hwan Kim, Suwon (KR); Kuen-dong Ha, Seongnam (KR); Joon-soo Bae, Seoul (KR); Du-seob Aum, Suwon (KR); Nozomu Arimoto, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 176 days.

This patent is subject to a terminal disclaimer.

(21) Appl. No.: 10/269,075

(22) Filed: Oct. 11, 2002

(65) Prior Publication Data

US 2003/0117057 A1 Jun. 26, 2003

(30) Foreign Application Priority Data

Oct. 23, 2001 (KR) ..... 2001-65365

(51) Int. Cl.
*H01J 29/80* (2006.01)

(52) U.S. Cl. ..... 313/404; 313/402; 313/405; 313/407

(58) Field of Classification Search ..... 313/402, 313/404, 405, 407
See application file for complete search history.

(56) References Cited

U.S. PATENT DOCUMENTS

| | | | | |
|---|---|---|---|---|
| 5,111,107 | A | 5/1992 | Kume et al. | |
| 5,751,098 | A * | 5/1998 | Ito et al. | 313/402 |
| 6,512,326 | B1 * | 1/2003 | Arai et al. | 313/407 |
| 6,590,326 | B1 * | 7/2003 | Diven et al. | 313/402 |

FOREIGN PATENT DOCUMENTS

| | | |
|---|---|---|
| JP | 08-124489 | 5/1996 |
| JP | 11-317176 | 11/1999 |

* cited by examiner

*Primary Examiner*—Karabi Guharay
*Assistant Examiner*—Matt Hodges
(74) *Attorney, Agent, or Firm*—Stein, McEwen & Bui, LLP

(57) ABSTRACT

A color CRT includes a panel having a fluorescent film formed on an inner surface, a tension mask frame assembly installed in the panel and including a frame including a pair of first and second support members separated a predetermined distance from each other, and first and second elastic members installed between the first and second support members to support the first and second support members and having support portions fixed at the first and second support members and a connection portion to connect the support portions, a mask having electron beam passing holes formed therein and installed such that a tension is applied to the first and second support members, and a correction unit installed at the first and second support members or support portions between the connection portion and the mask, to correct a mis-landing of an electron beam due to thermal expansion of the mask and the frame.

36 Claims, 9 Drawing Sheets

MASK FRAME ASSEMBLY HAVING THERMAL CORRECTION UNIT AND COLOR CRT USING THE SAME

CROSS-REFERENCE TO RELATED APPLICATIONS

This application claims the benefit of Korean Application No. 2001-65365, filed Oct. 23, 2001, in the Korean Intellectual Property Office, the disclosure of which is incorporated herein by reference.

BACKGROUND OF THE INVENTION

1. Field of the Invention

The present invention relates to a color CRT (cathode ray tube), and more particularly, to a mask frame assembly in which a creep deformation due to a thermal process of a mask receiving a tension is prevented and a thermal compensation characteristic during the operation of a CRT is improved, and a color CRT adopting the same.

2. Description of the Related Art

In a typical color CRT, three electron beams emitted from an electron gun pass through electron beam passing holes of a mask having a color selection function and land on red, green and blue fluorescent substances of a fluorescent film formed on a screen surface of a panel to excite the fluorescent substances, thus forming an image.

In the above color CRT forming an image, the mask having a color selection function is largely divided into a dot mask, which is used in computer monitors, and a slot mask (or a slit mask), which is used in televisions.

Many studies have been made about a tension mask, which is one type of slot mask that is supported such that a tension is applied by a frame, considering a flat screen surface, to correct distortion of an image and increase a view angle of a screen. A frame and a mask frame assembly, where a mask is supported such that a tension is applied by the frame, are installed in a panel of a color CRT. FIGS. 1 and 2 show an example of such a color CRT.

Referring to the drawings, a color CRT includes a panel 13 having a flat screen surface 12. A fluorescent film 11 is formed on the flat screen surface 12. A tension mask frame assembly 20 is suspended at the inner surface of the panel 13. A funnel 15 is coupled to the panel 13 and forms a seal in which an electron gun 16 is installed in a neck portion 14 of the funnel 15. A deflection yoke 17 is installed at a cone portion of the funnel 15.

The tension mask frame assembly 20 includes a tension mask 22, where a plurality of slots 21 are formed, a pair of support members 23 to support one pair of opposite edges of the tension mask 22, and a pair of elastic members 24 to support end portions of each of the support members 23 so as to apply a tension to the tension mask 22. The mask frame assembly 20 is supported by spring supporters 25 at the support members 23 and the elastic members 24 and is suspended in the panel 13 by a hook spring 26 coupled to a stud pin (not shown) installed at the inner surface of the panel 13.

In the tension mask frame assembly 20 having the above structure, as the spring supporter 25 is heated by electron beams not passing through the slots 21, the spring supporter 25, which is formed of a bimetal, is deformed and moves the tension mask frame assembly 20 toward the panel 13. Thus, mis-landing of electron beams due to the thermal expansion of the tension mask frame assembly 20 is corrected. An example of the above tension mask frame assembly is disclosed in Japanese Patent Publication No. 8-124489.

Referring to FIGS. 3 and 4, a spring supporter 31, which is formed of a bimetal, is fixed to the outer circumferential surface of the frame. A spring 32, which has a coupling hole 32*a* to be coupled to a stud pin 13*a* installed on the inner surface of the panel 13, is fixed at one end portion of the spring support 31. The spring 32 is formed of a single material.

In a color CRT including a fixing structure of the tension mask frame assembly 20, as shown in FIGS. 1 and 3, after being deflected by the deflection yoke 17, the electron beam emitted from the electron gun 16 passes the electron beam passing holes of the tension mask 33 and lands on a fluorescent film to excite fluorescent substance coated thereon. In this process, part (15 through 25%) of the electron beam emitted from the electron gun 16 passes through the electron beam passing holes of the tension mask 33. The remaining part of the electron beam not passing through the electron beam passing holes hits the tension mask 33 and heats it. Thus, the tension mask 33 and the frame 34 supporting the tension mask 33 are thermally extended by being heated by the electron beam, that is, thermions.

The thermal expansion of the tension mask 33 and the frame 34 results in a displacement of the electron beam passing holes of the tension mask 33, which causes mis-landing of the electron beam onto the fluorescent film. The mis-landing of the electron beam is corrected as follows using the device shown in FIG. 4. The spring supporter 31 is formed of a bimetal, and when thermally deformed, the tension mask frame assembly 30 is moved toward the panel 13 so that the electron beam passing holes moved due to the thermal expansion of the tension mask 33 are positioned fitting to the trace of the electron beam. Thus, the thermal expansion of the tension mask frame assembly 30 is corrected.

However, as the spring supporter 31 thermally expands, the tension mask frame assembly 30 has a rotational component. Since the rotational component of the tension mask frame assembly 30 generates the mis-landing of the electron beam, the quality of an image deteriorates. Also, since the spring supporter 31 is formed of a bimetal, the manufacturing cost increases.

In the meantime, the tension mask frame assembly 30 undergoes an annealing process to remove stress due to welding the support members and the elastic members during the manufacturing process. In the annealing process, the tension mask frame assembly 30 is heated up to around 500° C. Here, due to a difference between the amount of thermal expansion of the frame 34 and the amount of thermal expansion of the mask 33, the mask 33 is plastically deformed so that a tension decreases (by 50% of a tension before the annealing process). That is, as the mask frame assembly 30 is heated, a difference in the amount of thermal expansion is generated because the heat capacity of the mask 33 is less than that of the frame 34. The difference in the amount of thermal expansion acts as an additional tension to the tension mask 33 supported at the support member so that the tension of the tension mask 33 decreases after the annealing process. The decrease in the tension of the tension mask 33 causes a howling phenomenon when the tension mask 33 is installed at a color CRT and used therein, or produces an electron beam drift phenomenon due to the thermal deformation of the mask.

To solve the above problem, a mask frame assembly to prevent the operation of the amount of expansion of the frame in a direction in which the tension acts on the mask is disclosed in U.S. Pat. No. 5,111,107. The disclosed mask frame assembly is shown in FIG. 5. As shown in the drawing, the mask frame assembly 40 includes support bars 41 installed at the opposite positions, elastic support members 42 and 42 installed between the support bars 41 to support the support bars 41, a mask 43 supported by the support bars 41, and metal members 44 installed at the surfaces of the elastic support members 42 opposite to the surfaces facing the mask 43 and having a thermal expansion coefficient greater than that of the elastic support members 42.

In the above mask frame assembly 40, a tension of the mask 43 is lowered in spite of the attachment of the metal members 44. Also, the effect of the metal members 44 varies according to the distribution of the tension.

A color CRT having a structure of a mask frame assembly to prevent reduction of a tension of a mask during the annealing process is disclosed in Japanese Patent Publication No. 11-317176. The disclosed color CRT has a color selection electrode in which a grid is suspended at a frame having a pair of support bodies facing each other and a pair of elastic support members installed between the support bodies. In the disclosed color CRT, a control member having a thermal expansion coefficient that is low at a lower temperature and is high in a high temperature area, compared to a thermal expansion coefficient of the elastic support bodies, is fixed at the surface opposite to the grid of the elastic support members, or a control member having the opposite characteristic is fixed at the elastic support member at the side opposite to the grid. Since a color selection apparatus of the color CRT having the above structure is merely the control member using a difference in the thermal expansion coefficient which is attached to the elastic support members, the above problems are fundamentally solved.

SUMMARY OF THE INVENTION

To solve the above and other problems, it is an object of the present invention to provide a tension mask frame assembly which improves a thermal compensation characteristic due to thermal expansion by the electron beam emitted from an election gun and has a simplified structure to reduce the manufacturing cost, and a color CRT using the same.

It is another object of the present invention to provide a tension mask frame assembly which prevents reduction of a tension of a mask due to a plastic deformation of the mask due to a difference in the amount of thermal expansion between the mask and the frame in an annealing process and further prevents a drift phenomenon of an electron beam generated as the mask expands, and a color CRT using the same.

It is yet another object of the present invention to provide a tension mask frame assembly that prevents a mis-landing of an electron beam caused by the rotation of the tension mask frame assembly due to thermal expansion, and a color CRT using the same.

Additional objects and advantages of the invention will be set forth in part in the description which follows and, in part, will be obvious from the description, or may be learned by practice of the invention.

To achieve the above and other objects, there is provided a tension mask frame assembly for a color CRT according to an embodiment of the invention comprising a frame including a pair of first and second support members separated a predetermined distance from each other, and first and second elastic members installed between the first and second support members to support the first and second support members and having support portions fixed at the first and second support members and a connection portion to connect the support portions, a mask having electron beam passing holes and which is installed such that a tension is applied to the first and second support members, a correction unit installed at the first and second support members or at support portions between the connection portion and the mask, to correct a mis-landing of an electron beam due to thermal expansion of the mask and the frame by changing a radius of curvature in a tube axis direction of the first and second support members and the tension mask by a difference in the thermal expansion amount between the first and second elastic members and the first and second support members, and single-metal hook members selectively installed at the first and second support members and the first and second elastic members.

According to an aspect of the present invention, the correction unit is a bar having end portions, each of the end portion beings fixed at a corresponding one of the end portions of the first and second support members, and a thermal expansion coefficient of the bar is less than that of the first and second elastic members.

According to another aspect of the present invention, a cross-section of the bar is a plate having a changed cross-section, where a sectional coefficient of the plate prior to the change is A, and a sectional coefficient after the plate after the change is B, $B>2\times A$, and the correction bar is an angle bar.

According to another embodiment of the invention, there is provided a tension mask frame assembly comprising a tension mask having slots formed in a Y direction corresponding to a direction along which tension is applied, and a frame to support long sides portions of the tension mask in an X direction that is a lengthwise direction of the tension mask and which applies a tension to the tension mask, wherein, assuming that a thermal drift correction coefficient for correcting a mis-landing of an electron beam generated as the tension mask is heated by the electron beam and thermally expands is C, a radius of curvature before the thermal expansion of long side portions of the tension mask of a Z axis that is a tube axis direction or support members of the frame supporting the long side portions of the tension mask is Rz, and the amount of change of the radius of curvature in the Z axis direction when the tension mask and the frame thermally expand is $\Delta Rz$, the mis-landing of an electron beam due to the thermal expansion of the tension mask frame assembly is corrected by a change in the radius of curvature that is expressed as $\Delta Rz=C\times Rz^2$.

According to a further embodiment of the invention, there is provided a color CRT comprising a panel having a fluorescent film formed on an inner surface thereof, a tension mask frame assembly installed in the panel and including a frame including a pair of first and second support members separated a predetermined distance from each other, and first and second elastic members installed between the first and second support members to support the first and second support members and having support portions fixed at the first and second support members and a connection portion to connect the support portions, a mask having electron beam passing holes and which is installed such that a tension is applied to the first and second support members, and a correction unit installed at the first and second support members or support portions between the connection portion and the mask, to correct a mis-landing of an electron beam due to thermal expansion of the mask and the frame, wherein, assuming that a thermal drift correction coefficient is C, a radius of curvature before the thermal expansion of a Z axis that is a tube axis direction is Rz, and the amount of change of the radius of curvature in the Z axis direction of the tension mask supported at the first and second support members when the frame, the tension mask, and the correction unit thermally expand is ΔRz, a mis-landing of an electron beam due to the thermal expansion of the tension mask frame assembly is corrected by a change in the radius of curvature that is expressed as $\Delta Rz=C\times Rz^2$, a funnel sealed to the panel and having an electron gun installed in a neck portion thereof, and a deflection yoke installed at a cone portion of the funnel.

According to another aspect of the present invention, each of the first and second support members is formed of a fixed portion to support the tension mask and a flange portion extending inwardly from an end portion of the fixed portion, and the correction unit includes a bar having end portions, each of the end portions being fixed at the corresponding one of the fixed portions of the first and second support members.

According to yet another aspect of the present invention, the thermal drift correction coefficient is within a range of $1.0\times10^{-7}$ through $3.0\times10^{-6}$.

BRIEF DESCRIPTION OF THE DRAWINGS

The above and other objects and advantages of the present invention will become more apparent and better appreciated by describing in detail embodiments thereof with reference to the accompanying drawings in which.

DETAILED DESCRIPTION OF THE EMBODIMENTS

Figure 1:
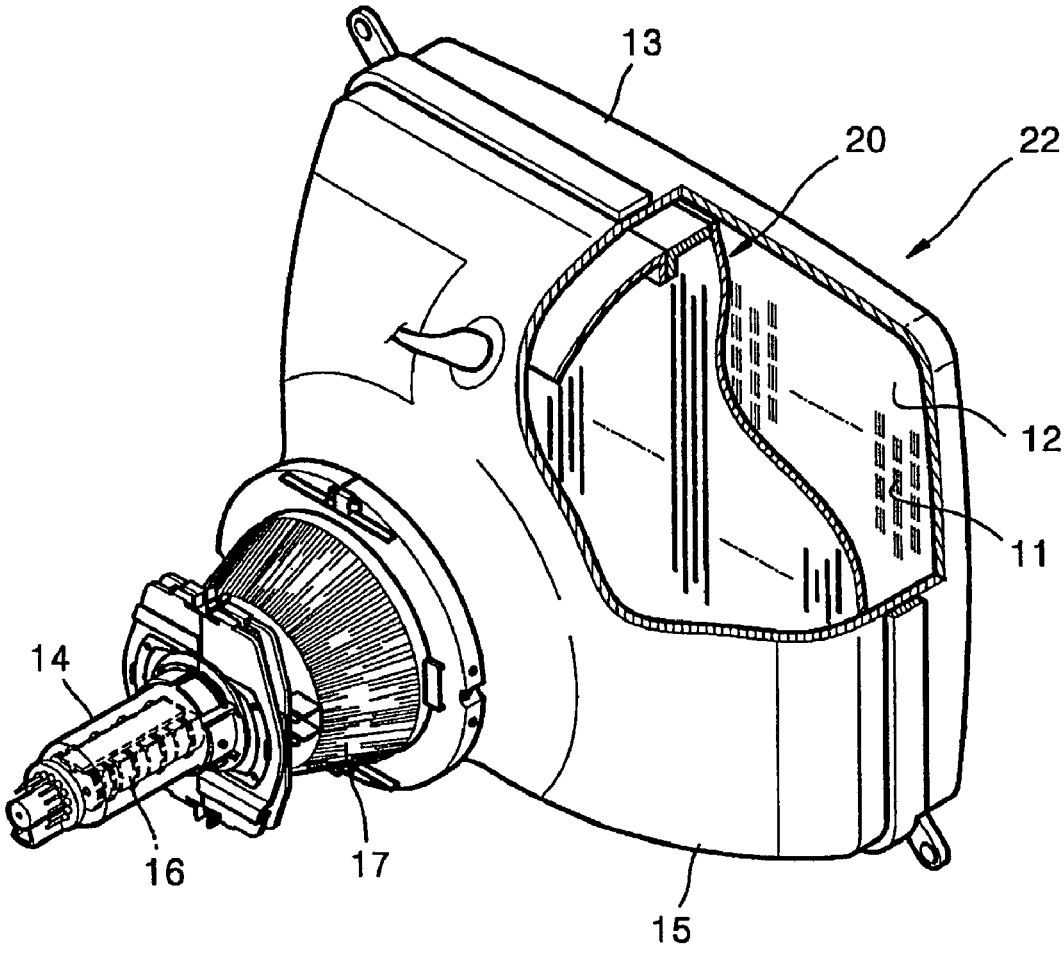
FIG. 1 (PRIOR ART)
FIG. 1 is a partially cut-away perspective view of a conventional color CRT.
Figure 2:
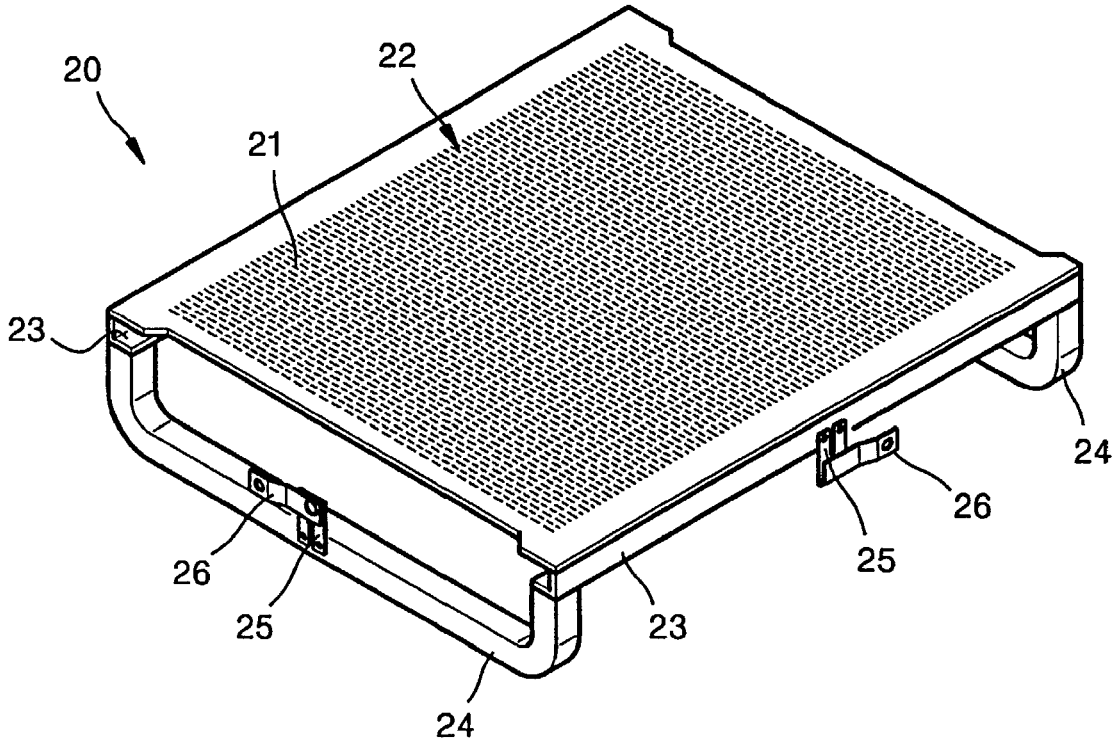
FIG. 2 (PRIOR ART)
FIG. 2 is a perspective view of a conventional tension mask frame assembly.
Figure 3:
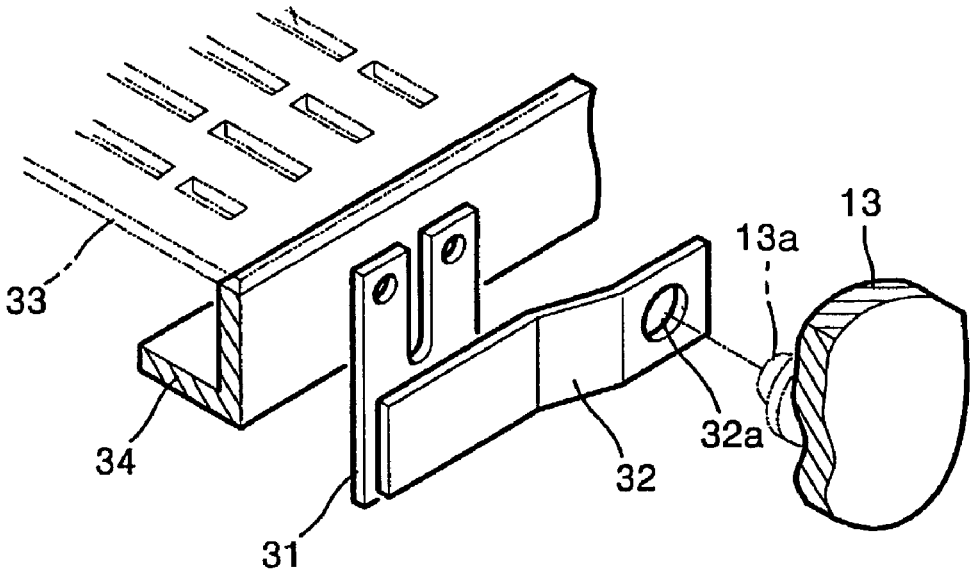
FIG. 3 (PRIOR ART)
FIG. 3 is a partially cut-away perspective view showing the state in which the conventional tension mask frame assembly is installed at a panel.
Figure 4:
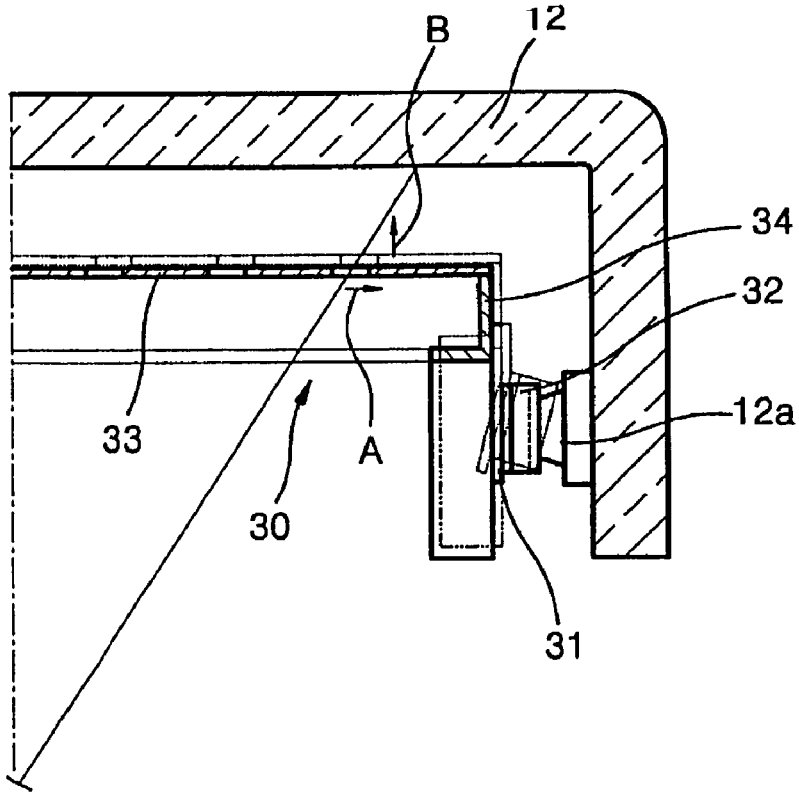
FIG. 4 (PRIOR ART)
FIG. 4 is a sectional view showing the thermal expansion of the tension mask frame assembly of FIG. 3 in the panel.
Figure 5:
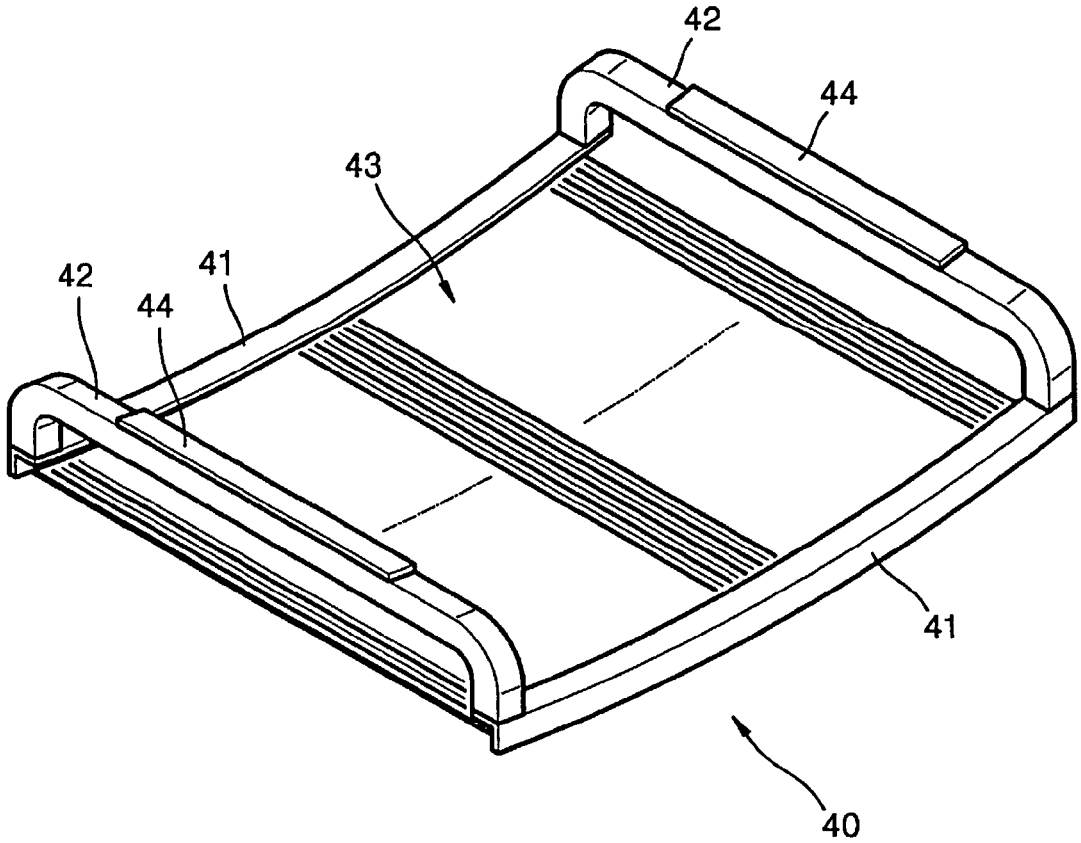
FIG. 5 (PRIOR ART)
FIG. 5 is a perspective view of another conventional tension mask frame assembly.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 6:
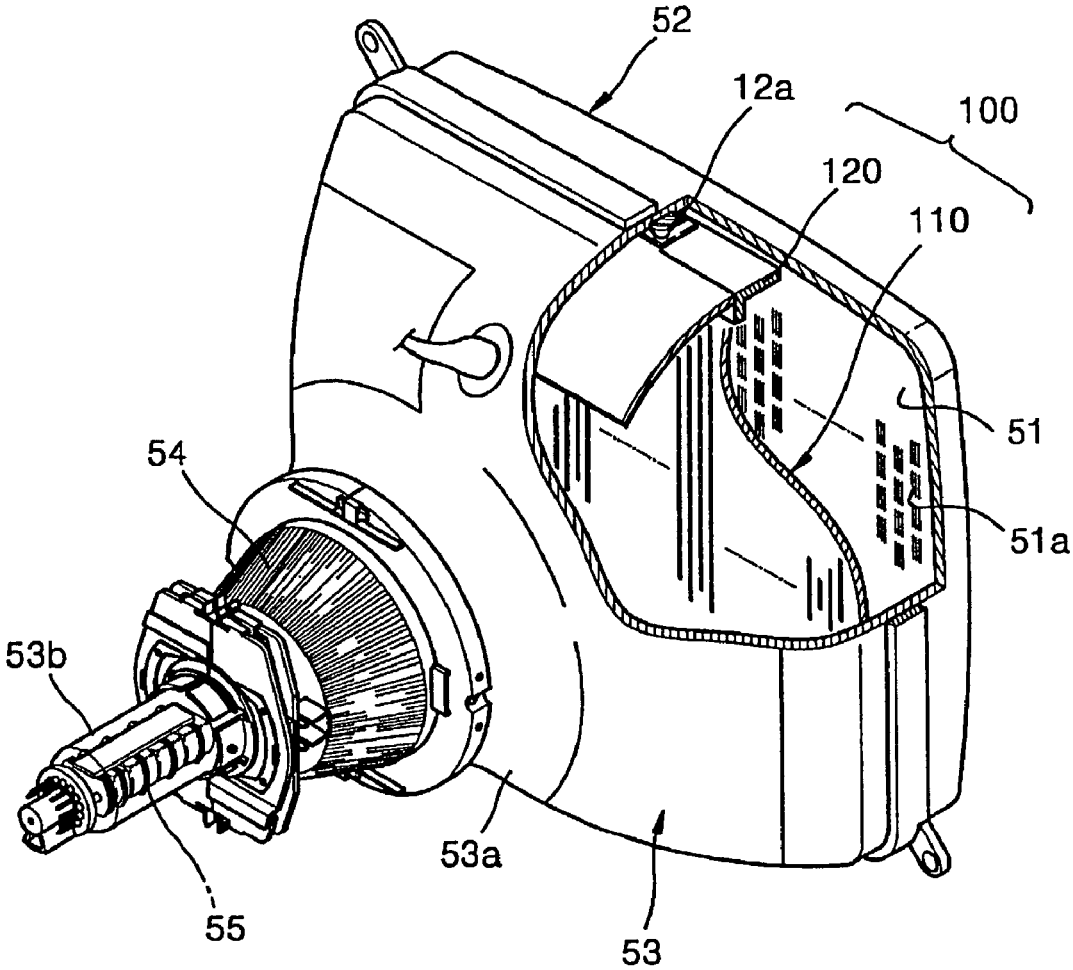
FIG. 6 is a partially cut-away perspective view of a CRT according to an embodiment of the present invention.

Referring to FIG. 6, a color CRT according to an embodiment of the present invention includes a panel 52 having a screen 51, which is a flat surface where a fluorescent film 51*a* is formed. A funnel 53 is sealed to the panel 52 and has a cone portion 53*a* and a neck portion 53*b*, a deflection yoke 54 installed at the cone portion 53*a* and the neck portion 53*b* of the funnel 53, and an electron gun 55 installed at the neck portion 53*b*. A tension mask frame assembly 100 having a color selection function of the electron beam emitted from the electron gun 55 is installed in the panel 52.

Figure 7:
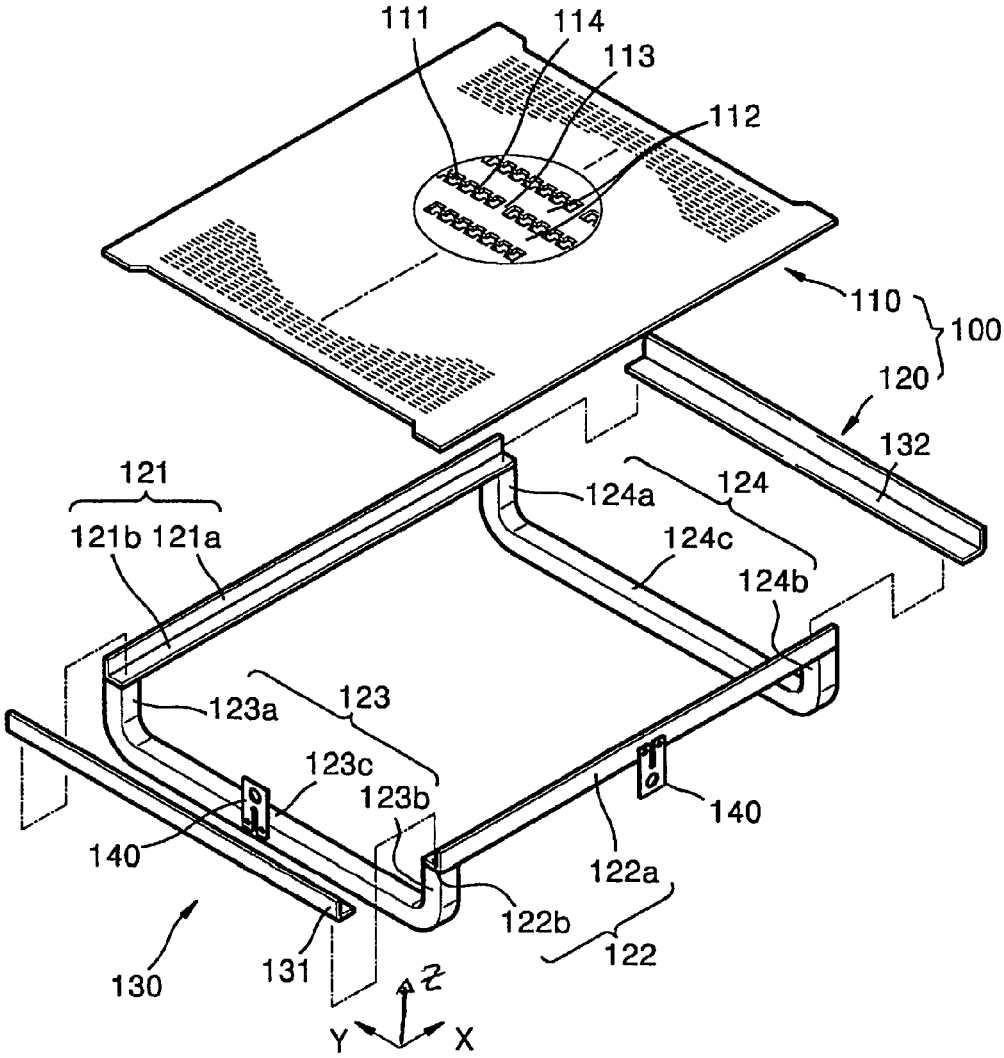
FIG. 7 is an exploded perspective view of a tension mask frame assembly according to an embodiment of the present invention.

The tension mask frame assembly 100, as shown in FIG. 7, includes a tension mask 110 having electron beam passing holes, which are longer in a Y direction (a direction along which a tension is applied). A frame 120 supports the long sides of the tension mask 110 corresponding to an X direction (a lengthwise direction of the tension mask 110) and applies a tension to the tension mask 110. In the tension mask frame assembly 100, the mis-landing of the electron beam generated due to thermal expansion is corrected as the tension mask frame assembly 100 is deformed in a direction in which a radius of curvature expressed in an equation that $\Delta Rz=C\times Rz^2$. Specifically, a radius of curvature of the tension mask frame assembly 100 increases or is made flat, assuming a thermal drift correction coefficient is C, a radius of curvature of a Z axis, which is an axis of a tube before the thermal expansion of the long sides of the mask 110 or the support member 121,122 of the frame 120 that supports the mask 110, is Rz, and the amount of a change in the radius of curvature in the Z axis direction when the tension mask 110 and frame 120 thermally expand is ΔRz.

The tension mask frame assembly 100 in which a mis-landing of the electron beam according to the thermal expansion is corrected is described in detail below. As shown in FIG. 7, the tension mask frame assembly 100 includes the tension mask 110 and the frame 120 supporting the tension mask 110 to apply a tension thereto. The tension mask 110 is a thin plate and includes strips 112 separated a predetermined distance and forming electron beam passing holes 111, real bridges 113 connecting the neighboring strips 112 to section the electron beam passing holes 111, and dummy bridges 114 extending between the neighboring strips 112 in the opposite direction to section the electron beam passing holes 111. The tension mask 110 is not limited to the above-described embodiment and it is understood that any tension mask structure which can apply a tension can be used.

The frame 120 supports opposite edges of the tension mask 110 and includes a pair of first and second support members 121 and 122 separated a predetermined distance from each other, and first and second elastic members 123 and 124 to support the first and second support members 121 and 122 so that a tension can be applied to the tension mask 110 supported at the first and second support members 121 and 122. The first and second support members 121 and 122 include fixed portions 121*a* and 122*a* to support the tension mask 110, and flange portions 121*b* and 122*b* inwardly extending from the fixed portions 121*a* and 122*a*.

The first and second elastic members 123 and 124 support the first and second support members 121 and 122 and include support portions 123*a*, 123*b*, and 124*a*, 124*b* respectively fixed to the first and second support members 121 and 122, and connection portions 123*c*, and 124*c* connecting the support portions 123*a* and 123*b*, and 124*a* and 124*b*. The structures of the first and second support members 121 and 122 and the first and second elastic members 123 and 124 are not limited to the above embodiment and it is understood that any structure capable of applying a tension to the tension mask 110 can be adopted.

A correction unit 130 is provided between an upper portion of the connection portions 123*c* and 124*c* of the first and second elastic members 123 and 124 and a lower portion of the tension mask 110, to correct a mis-landing of an electron beam generated due to the thermal deformation of the tension mask 110 and the frame 120 by generating a difference in thermal expansion between the first and second elastic members 123 and 124 and the first and second support members 121 and 122 so that plastic deformation of the tension mask 110 due to a thermal process of the tension mask 110 is prevented.

Figure 8A:
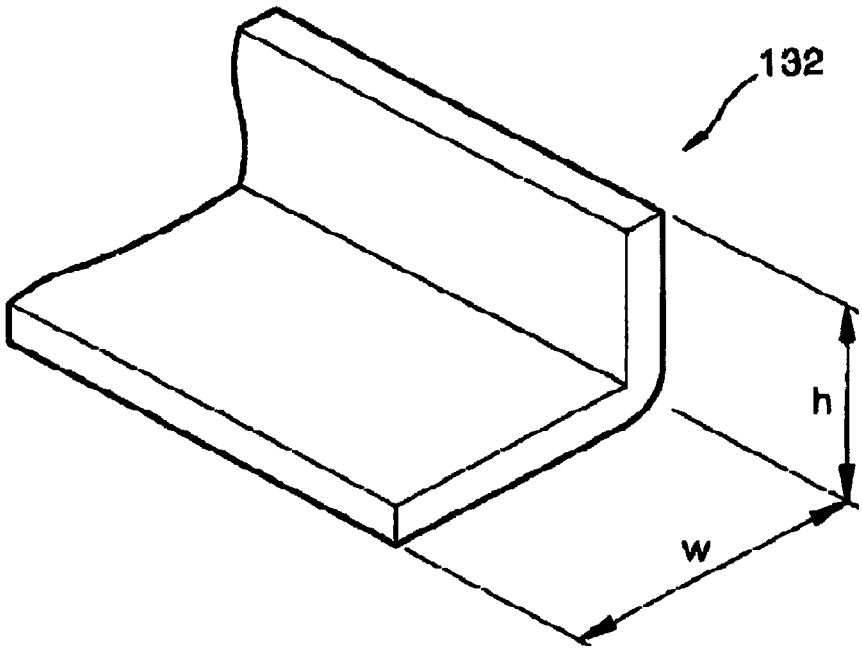
FIG. 8A is a perspective view of an angle bar according to an embodiment of the present invention.

The correction unit 130 includes first and second angle bars 131 and 132 having both end portions connected to either the flange portions 121*b* and 122*b* of the first and second support members 121 and 122 or the support portions 123*a* and 123*b*, and 124*a* and 124*b*. Here, assuming that the width and height of each of the angle bars 131 and 132 are W and H, respectively, as shown in FIG. 8A for angle bar 132, the angle bars 131 and 132 are formed such that the ratio of the height to the width (h/w) is within a range between 20% through less than 100%, and preferably, 25%.

Here, the relationship of thermal expansion coefficients of the first and second angle bars 131 and 132, the first and second elastic members 123 and 124, and the tension mask 110 is as follows. Thermal expansion coefficients of the first and second angle bars 131 and 132 are less than those of the first and second elastic members 123 and 124. Thermal expansion coefficients of the first and second elastic members 123 and 124 are less than those of the tension mask 110. Heat capacities of the first and second angle bars 131 and 132 are greater than those of the tension mask 110 but less than those of elastic members 123 and 124. The relationship of the thermal expansion coefficients and heat capacities of the first and second angle bars 131 and 132 and the first and second elastic members 123 and 124 can be adjusted considering the amount of correction of a mis-landing of the electron beam due to the movement of slots 111 of the mask 110 that are electron beam passing holes 111 caused by the thermal expansion of the tension mask 110 which is discussed later.

The correction unit 130 is not limited to the angle bars 131 and 132 supported at the first and second support members 121 and 122 or the support portions 123*a* and 123*b*, and 124*a* and 124*b* of the first and second elastic members 123 and 124. Any structure capable of preventing plastic deformation or creep deformation of the tension mask 110 during a thermal process after the tension mask 110 is welded to the frame 120 and which performs thermal correction due to the thermal expansion of the tension mask 110 and the frame 120 can be used. For example, embodiments of the bar include bars with circular, polygonal, rectangular, or triangular cross sections, or a flat bar having a profile changed in the lengthwise direction.

When the profile of the flat bar is changed, assuming that a modulus of one section of the flat bar is A and a modulus of another section of the flat bar after a change is B, the profile is changed to satisfy an inequality that B>2×A. This inequality is to limit the amount of sagging of a member forming a correction unit within a range of a management of production after the heat process of the tension mask frame assembly having the correcting unit.

Figure 8B:
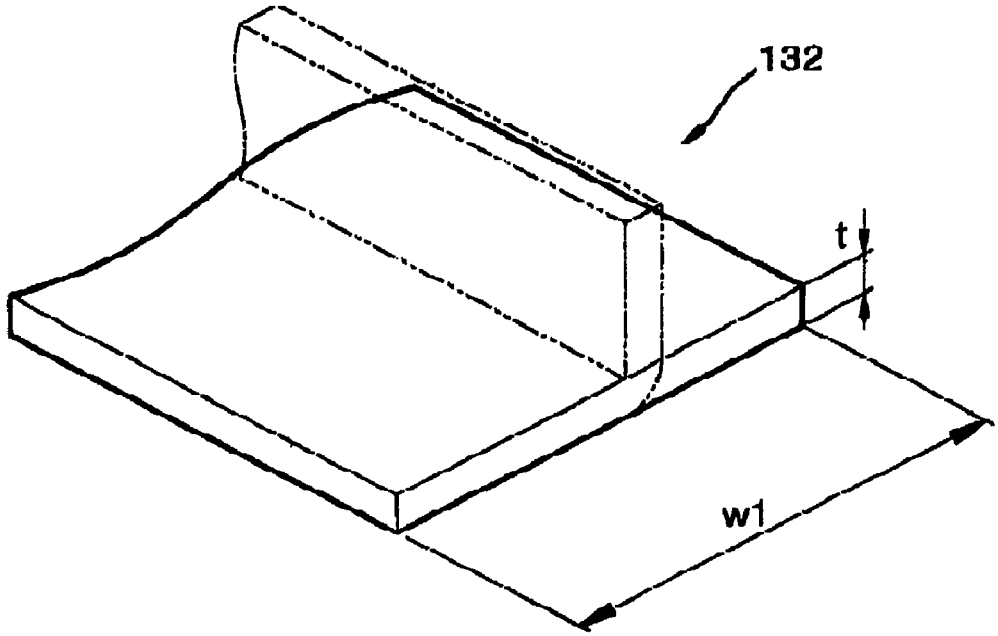
FIG. 8B is a perspective view showing a state in which the section of the plate bar is deformed according to an embodiment of the present invention.

Specifically, when a thickness of the plate bar is t and a width of a lower side thereof is w1 as shown in FIG. 8B, a sectional coefficient (modulus) B of the plate bar is expressed by $$B = \frac{w1 \times t^3}{12}.$$

To double the sectional coefficient, the thickness must be increased by about 20% as can be seen from the above equation. However, where the section is changed in a direction perpendicular to the lengthwise direction of the plate bar as shown in FIG. 8A, the sectional coefficient (modulus) can be increased without increasing the thickness.

The first and second angle bars 131 and 132 that are the correction unit 130 are resistance-welded to the end portions of the first and second support members 121 and 122. In this case, since the welded portions of the first and second support members 121 and 122 and the bar are deformed due to heat produced during welding, argon welding is preferably used to minimize the welding heat according to an embodiment of the invention. However, other modes of attachment can be used.

Hook members 140 to suspend the tension mask frame assembly 100 in the panel 52 are installed at the first and second support members 121 and 122 and the first and second elastic members 123 and 124. According to an embodiment of the invention, hook members 140 are formed of a single metal, and not a bimetal. However, bimetal hook members 140 can be used.

The operation of the tension mask frame assembly 100 according to an embodiment of the present invention having the above structure is described as follows. In the tension mask frame assembly 100, to weld the tension mask 110 to the first and second support members 121 and 122 of the frame 120, an external force is applied to the first and second support members 121 and 122 supported at the first and second elastic members 123 and 124 in the opposite directions. By doing so, as the first and second elastic members 123 and 124 are elastically deformed, the interval between the first and second support members 121 and 122 decreases. In this state, the edges of the opposite sides of the mask 110 are welded to the fixed portions 121*a* and 122*a* of the first and second support members 121 and 122. Then, when the external force applied to the first and second support members 121 and 122 is removed, a tension is applied to the tension mask 110 by an elastic force of the first and second elastic members 123 and 124.

When the installation of the tension mask 110 is completed, the end portions of the first and second angle bars 131 and 132, which are the correction unit 130, formed of a material having a thermal expansion coefficient less that those of the first and second elastic members 123 and 124 are installed between the upper surfaces of the connection portions 123*c* and 124*c* of the first and second elastic members 123 and 124 and the lower portion of the tension mask 110. Each of the end portions of the first and second angle bars 131 and 132 are fixed on the upper surfaces of the flange portions 121*b* and 122*b* of the first and second support members 121 and 122. When the installation of the tension mask 110 and the correction unit 130 is completed, a thermal process is performed to heat the tension mask frame assembly 100 up to around 500° C. so as to anneal the mask 110 and frame 120 and to remove stress produced therein. In the thermal process, as the tension mask frame assembly 100 is heated, the tension mask 110, the frame 120, and the first and second angle bars 131 and 132 of the correction members 130 thermally expand. Here, since the thermal expansion coefficient of the correction member 130 is less than those of the first and second elastic members 123 and 124, the amount of thermal expansion of the correction portion 130 is less than that of the first and second elastic members 123 and 124. Thus, the first and second support members 121 and 122 are prevented from being extended by the first and second elastic members 123 and 124. Therefore, a thermal expansion force of the first and second elastic members 123 and 124 is prevented from further acting as a tension on the tension mask 110. Also, this prevents the lowering of a tension or creep deformation by the deformation of part of the tension mask 110 as a tension is excessively applied to the tension mask 110 during the thermal process.

After the thermal process is completed, the tension mask frame assembly 100 is suspended at the inner surface of the panel 52 of a CRT and the hook members 140 are coupled to stud pins (not shown) provided on the inner surface of the panel.

When a color CRT in which the tension mask frame assembly 100 is suspended is driven, an electron beam emitted from the electron gun 55, some thermions do not pass through the electron beam passing holes 111 of the tension mask 110 and instead heat the tension mask 51 so that the tension mask 110 is heated and thermally expands. The thermal expansion initially causes the electron beam passing holes 111 to move, thus generating a mis-landing of the electron beam. As the frame 120 thermally expands, the mis-landing of the electron beam is corrected by a change in the radius of curvature of the tension mask 110 and the first and second support members 121 and 122 due to a difference of the thermal expansion amount between the angle bars 131 and 132 and the first and second support members 121 and 122, which are structural components of the frame 120.

Figure 9:
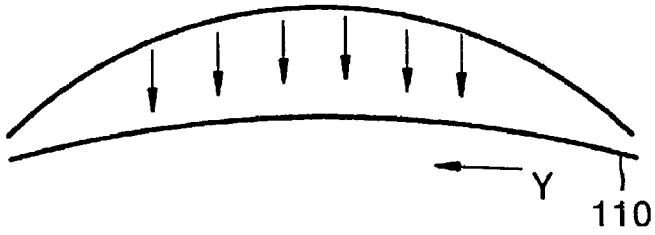
FIGS. 9 through 12 are views showing the curvature according to thermal expansion of the mask of the present invention.
Figure 10:
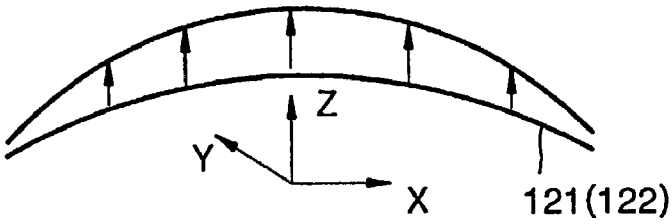
Figure 11:
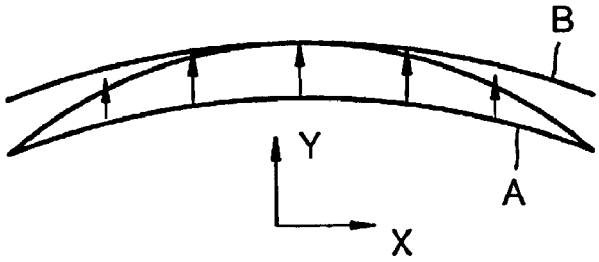

The above operation will be described in detail with reference to FIGS. 9 through 11 as follows. When both sides of the frame 120 are pressed to fix the tension mask 110 to the frame 120, the radius of curvature in a Y direction corresponding to a direction along the short side of the tension mask 110 decreases as shown in FIG. 9 (the surface of the tension mask becomes flat as the radius of curvature increases). The radius of curvature of the long side of the tension mask 110 in a Z direction that is a tube axis direction (i.e., the radius of the curvature of the first and second support members 121 and 122) increases, as shown in FIG. 10. In this state, since the angle bars 131 and 132 of the correction unit 130 are welded to the support portions 123*a* and 123*b*, and 124*a* and 124*b* of the first and second support members 121 and 122 or the first and second elastic members 123 and 124, the above-described radius of curvature is maintained.

Figure 12:
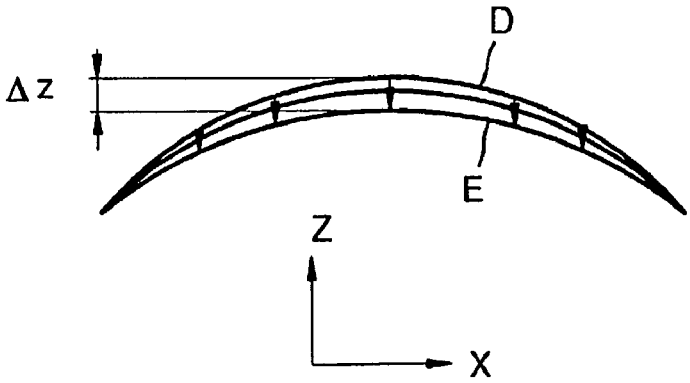

In this state, when the tension mask 110 and the frame 120 are heated by the driving of the color CRT, since a predetermined tension is applied in the Y direction of the tension mask 110, the tension mask 120 is deformed in the Y direction so that the tension of the tension mask decreases by 10%. However, when the frame 120 thermally expands, the periphery of the tension mask 110 is prevented from expanding due to a difference in the thermal expansion amount between the first and second elastic members 123 and 124 and the first and second angle bars 131 and 132. Thus, the radius of curvature in the Y direction of the tension mask 110 increases from a state A to a state B, as shown in FIG. 11. The radius of curvature in the Z direction corresponding to the long side portion of the tension mask 110 increases from a state D to a state E, as shown in FIG. 12. Thus, in view of the standard of a middle portion where the hook spring 140 of the tension mask 110 is installed, the radius of curvature of the Z direction in the tube axis direction increases so that the periphery is lifted. Therefore, the mis-landing state of the electron beam due to the thermal expansion of the tension mask 110 is corrected.

The above-described operation will be more clear through the following tests performed by the present inventor.

Test 1

In the present test, a CRT uses a tension mask frame assembly including a frame having a pair of first and second support members separated a predetermined distance from each other, and first and second elastic members installed between the first and second support members for supporting the first and second support members. The first and second elastic members have support portions fixed at the first and second support members and connection portions to connect the support portions, and a mask installed which is capable of applying a tension to the support members where a plurality of electron beam passing holes are formed. An angle bar was used as a correction mechanism and was installed between the first and second support members or support portions between the connection portion and the mask. The CRT was driven and a change in the displacement of a tension mask according to time was tested in an X axis (i.e., a direction along the long side of the mask), a Y axis (i.e., a direction along the short side of the mask), and a Z axis (i.e., the tube axis direction). The results of the are shown in Table 1 and a graph shown in FIG. 13.

TABLE 1

| Time (min) | Middle portion on X axis | Temperature (° C.) | Corner portion on Y axis (μm) | Corner portion on Z axis (μm) | Middle portion on Y axis (μm) | Middle portion on Z axis (μm) |
|---|---|---|---|---|---|---|
| 0 | | 29 | | | | |
| 1 | 0 | 45 | 4 | −4 | 20 | −9.5 |
| 2 | 0 | 68.8 | 15.25 | −8.75 | 65 | −17 |
| 3 | 0 | 88.7 | 24 | −7.5 | 136 | −31.5 |
| 4 | 0 | 108.1 | 28.25 | 0.75 | 171.5 | 20.5 |

Figure 13:
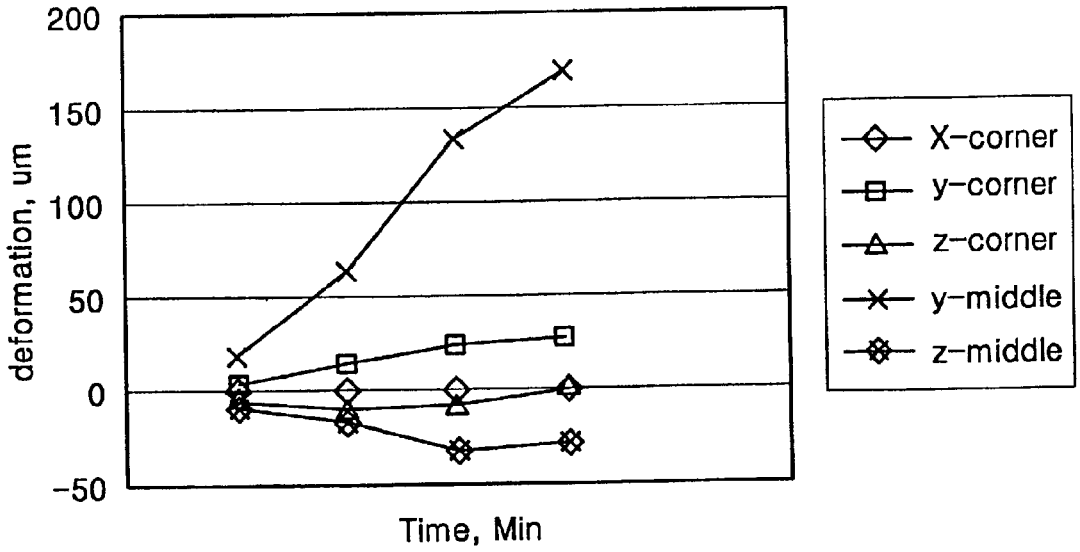
FIG. 13 is a graph showing the displacement of the tension mask frame assembly due to thermal expansion.

As can be seen from Table 1 and the graph of FIG. 13, as time increases, the radius of curvature in the tube axis direction changes. As the amount of displacement at the middle portion increases, the radius of curvature gradually increases so that the first and second support members remain flat.

The above flatness is made in the state in which the middle portions of the first and second support members are supported by the hook members, both end portions of the mask are moved toward the fluorescent film and further the mis-landing of an electron beam due to thermal expansion of the mask is corrected.

Test 2

In the present test, in a CRT uses the tension mask frame assembly, and a mis-landing of an electron beam generated as being heated by the electron beam emitted from the electron gun 55 and thermally expanded is measured. That is, the amount of a change in the radius of curvature in the Z direction (i.e., the tube axis direction during the thermal expansion of the tension mask and the frame) is measured by an equation that $\Delta Rz = C \times Rz^2$, assuming that a thermal drift correction coefficient is C and a radius of curvature of the long side portion of the mask or the support member of the frame supporting the long side portion of the mask before thermal expansion is Rz.

TABLE 2

| Radius of curvature (R) | ΔRz needed to move 10 μm | ΔRz needed to move 100 μm |
|---|---|---|
| 3,000 mm | 3.37 mm | 21.18 mm |
| 5,000 mm | 4.7 mm | 59.25 mm |
| 7,000 mm | 9.22 mm | 116.75 mm |

TABLE 3

| Radius of curvature (R) | ΔRz 1.00E−07 | 2.00E−07 | 5.00E−07 | 1.00E−06 | 2.00E−06 | 3.00E−06 |
|---|---|---|---|---|---|---|
| 3,000 mm | 0.90 | 1.80 | 4.50 | 9.00 | 18.00 | 27.00 |
| 5,000 mm | 2.50 | 5.00 | 12.50 | 25.00 | 50.00 | 75.00 |
| 7,000 mm | 4.90 | 9.80 | 24.50 | 49.00 | 98.00 | 147.00 |

From Table 2 and Table 3, the amount of displacement in the direction along the Z axis to be corrected during an actual thermal process or the operation of a color CRT is within a range of 10 through 100 μm. The range of ΔRz satisfying the range of the displacement amount is as shown in Table 2. When the radius of curvature in the Z direction of the tension mask of the color CRT used for actual televisions is 3,000 mm, 5,000 mm or 7,000 mm, the value of the correction efficient C to be within the range of ΔRz of Table 2 is shown in Table 3. Thus, a range of a correction coefficient of $1.0\times10^{-7}$ *through* $3.0\times10^{-6}$ is sufficient to satisfy the displacement amount of 10 through 100 μm in the Z direction using a reinforcement member according to the present invention.

Test 3

In the present test, in the tension mask frame assembly according to the above-described embodiments of the present invention, assuming that the profile shape of the correction mechanism (i.e., a width of a plate and angle bar is W and the height thereof is H), the relationship between a degree of the deterioration in a tension of the tension mask and the amount of heat correction according to the ratio of the width and height of the angle bar is tested and the result is shown in Table 4.

As shown in Table 4, it can be seen that, when the secondary section modulus is over a predetermined value, the lowering of a tension sensitively responding to the sag amount, the tension deterioration ratio, and the thermal drift correction characteristic of the tension mask becomes almost identical according to the size of the section and the thickness of the correction mechanism and the secondary section modulus (form factor). Also, as the test is performed by changing the ratio of the width and height of the angle bar to 25%, 50%, and 70%, the flexural rigidity changes to 888.3, 5078.7, and 11910.8, respectively. Thus, it can be seen that, as a bending ratio decreases, the amount of correction increases.

It can be seen from Table 4 that, when over a predetermined amount of flexural rigidity, the correction mechanism having a greater width and a low height with respect to the same entire width, (i.e., the angle bar), is advantageous. When the width of the bottom surface the angle bar is made great, the angle bar endures well a bending force at the point when bending is generated by the secondary sectional coefficient and the initial deformation amount due to a partial deformation at the point when a permanent deformation amount by the sectional area can be reduced. In particular, when an angle bar has a bending rate of 25% with respect to the above plate bar, since the angle bar has a bending rigidity of about ten times higher than that of the plate bar, a sectional coefficient of a member forming the correction unit preferably has a sectional coefficient of more than two times that of the plate bar. When the sectional coefficient of the member forming the correction unit is more than two times that of the plate bar, since the amount of sagging of the central portion of the correction unit after an annealing process of the tension mask frame assembly is reduced to ½

TABLE 4

| | Width (W, mm) | Height (H, mm) | Size of section (A, $mm^2$) | Section modulus ($mm^4$) | Amount of sag (mm) | Deterioration in periphery of tension mask (%) | Amount of heat correction at the corner of tension mask (μm) |
|---|---|---|---|---|---|---|---|
| Plate bar | 30 | — | 90 | 67.5 | 3–5 | −15~−20 | Over −27 |
| Angle bar having the same width (W) and height (H) | 16.5 | 16.5 | 90 | 1430.2 | 0.5 | −10~−15 | −25 |
| Angle bar whose height (H) is greater than (W) | 22 | 11 | 90 | 345.1 | 0.35 | −10~−15 | −15 |

or less, a management dispersion is accordingly reduced to be ½ so as to be included in a range in production management is possible. Thus, to increase the sectional coefficient of the plate bar by more than two times by using the correction unit, the thickness of the plate must be increased. However, when the section is changed in a direction perpendicular to the lengthwise direction of the plate bar, the same effect of increasing the thickness of the plate can be obtained without additional increase in the cost for materials.

As described above, in the tension mask frame assembly for a color CRT according to the present invention, since the thermal drift amount of the tension mask is adjusted by using a bending force due to a difference in the thermal expansion amount of the angle bar that is a correction mechanism, the first and second elastic members, and the first and second support members, the amount of correction produced by correcting the thermal expansion and the amount of movement of an electron beam according to the amount of rotation of the frame with respect to the panel can be minimized. Furthermore, color purity of an image formed on the fluorescent film is excited by the electron beam can be improved.

While this invention has been particularly shown and described with reference to embodiments thereof, it will be understood by those skilled in the art that various changes in form and details may be made therein without departing from the spirit and scope of the invention as defined by the accompanying claims and equivalents thereof.

What is claimed is:

1. A tension mask frame assembly for a color CRT comprising:

a frame comprising:

first and second support members separated a predetermined distance from each other, and first and second elastic members installed between the first and second support members to support the first and second support members, each of the first and second elastic members having a connection portion and support portions separated by and connected to corresponding opposite sides of the connection portion, each of the support portions being fixed to a corresponding one of the first and second support members;

a mask having electron beam passing holes formed therein and installed such that tension is applied by the first and second support members;

a correction unit connecting the first and second support members or connecting the support portions at a location of the first and second elastic members between the connection portion and said mask, said correction unit to correct a mis-landing of an electron beam due to a thermal expansion of said mask and said frame by changing a radius of curvature in a tube axis direction of the first and second support members and said mask by a difference in the thermal expansion amount between the first and second elastic members and the first and second support members; and single-metal hook members selectively installed at the first and second support members and the first and second elastic members.

2. The tension mask frame assembly as claimed in claim 1, wherein said correction unit is a bar having end portions, each of the end portions being fixed at a corresponding one of the end portions of the first and second support members.

3. The tension mask frame assembly as claimed in claim 2, wherein a thermal expansion coefficient of the bar is less than a thermal expansion coefficient of the first and second elastic members.

4. The tension mask frame assembly as claimed in claim 2, wherein:

a cross section of the bar is a plate having a variable cross section, the cross section of the plate is changed such that the bar satisfies an inequality of $B>2\times A$, A is a sectional modulus of the correction unit prior to the change in the cross section, and B is a sectional modulus after the change in the cross section.

5. The tension mask frame assembly as claimed in claim 1, wherein said correction unit comprises an angle bar.

6. The tension mask frame assembly as claimed in claim 5, wherein:

a width of a bottom surface of the angle bar is W, a height of the angle bar is H, and a ratio H to W is at or between 20% and 100%.

7. A tension mask frame assembly comprising:

a tension mask having a plurality of slots formed in a Y direction and having long side edges along an X direction, where tension is applied to said tension mask along the Y direction; and a frame having support members to support said tension mask at the long side edges in the X direction and to apply the tension to said tension mask, wherein:

a mis-landing of an electron beam due to thermal expansion of the tension mask frame assembly is corrected by a change in a radius of curvature that is expressed in an equation as $\Delta Rz=C\times Rz^2$, in which C is a thermal drift correction coefficient for the tension mask frame assembly to correct the thermal expansion due to heat generated by a mis-landing of electron beams on said tension mask, Rz is a radius of curvature before the thermal expansion of the long side edges of said tension mask along a Z axis, which is a direction perpendicular to both the X and Y directions, and $\Delta Rz$ is an amount of change of the radius of curvature in the Z axis direction when said tension mask and said frame thermally expand.

8. The tension mask frame assembly as claimed in claim 7, wherein the thermal drift correction coefficient is within a range of $1.0\times10^{-7}$ through $3.0\times10^{-6}$.

9. The tension mask frame assembly as claimed in claim 7, further comprising a means for correcting the mis-landing of the electron beam such that the mis-landing of the electron beam due to the thermal expansion of the tension mask frame assembly is corrected by the change in the radius of curvature that is expressed in the equation as $\Delta Rz=C\times Rz^2$.

10. A tension mask frame assembly comprising:

a frame including:

first and second support members separated a predetermined distance from each other, and first and second elastic members installed between the first and second support members to support the first and second support members, each of the first and second elastic members having support portions connected by a connection member, each of the support portions being fixed to a corresponding one of the first and second support members;

a mask having a plurality of electron beam passing holes and installed such that tension is applied by the first and second support members; and a correction unit installed at the first and second support members or at the support portions between the connection portion and said mask, said correction unit to correct a thermal expansion of said mask and said frame caused by a mis-landing of an electron beam on said mask, wherein the thermal expansion due to the mis-landing of the electron beam is corrected by a change in a radius of curvature that is expressed in an equation as $\Delta Rz=C\times Rz^2$, C is a thermal drift correction coefficient of the tension mask frame assembly, Rz is a radius of curvature before the thermal expansion along a Z axis, which is parallel with an axial direction of the support portions, and ΔRz is an amount of change of the radius of curvature in the Z axis direction of said mask while being supported at the first and second support members when said frame, said mask, and said correction unit thermally expand.

11. The tension mask frame assembly as claimed in claim 10, wherein said correction unit comprises a bar having end portions, each of the end portions being fixed at a corresponding one of the end portions of the first and second support members.

12. The tension mask frame assembly as claimed in claim 11, wherein a thermal expansion coefficient of the bar is less than a thermal expansion coefficient of the first and second elastic members.

13. The tension mask frame assembly as claimed in claim 11, wherein:

the bar comprises a plate having a variable cross section which satisfies an inequality that $B>2\times A$, A is a sectional modulus of the plate prior to the change in the cross section, and B is a sectional modulus after the cross section is changed.

14. The tension mask frame assembly as claimed in claim 11, wherein said correction bar comprises an angle bar.

15. The tension mask frame assembly as claimed in claim 14, wherein:

a width of a bottom surface of the angle bar is W, a height of the angle bar is H, and a ratio of H to W is at or between 20% and 110%.

16. The tension mask frame assembly as claimed in claim 14, wherein:

a width of a bottom surface of the angle bar is W, a height of the angle bar is H, and a ratio of H to W is 25%.

17. A color CRT comprising:

a panel having a fluorescent film formed on an inner surface;

a tension mask frame assembly installed in said panel and including a frame, the frame including first and second support members separated a predetermined distance from each other, first and second elastic members installed between the first and second support members to support the first and second support members, each of the first and second elastic members having support portions connected by a connection portion, each of the support portions being fixed at a corresponding one the first and second support members, a mask having a plurality of electron beam passing holes and installed such that tension is applied by the first and second support members, and a correction unit installed at the first and second support members or at the support portions between the connection portion and the mask, the correction unit to correct a thermal expansion of said tension mask frame assembly caused by a mis-landing of an electron beam on the mask, wherein the thermal expansion of said tension mask frame assembly is corrected by a change in a radius of curvature that is expressed in an equation as $\Delta Rz=C\times Rz^2$, C is a thermal drift correction coefficient of said tension mask frame assembly, Rz is a radius of curvature before the thermal expansion along a Z axis, which is parallel to an axial direction of the support portion, and ΔRz is an the amount of change of the radius of curvature in the Z axis direction of the mask supported at the first and second support members when the frame, the mask, and the correction unit thermally expand;

a funnel sealed to said panel, said funnel having a neck portion and a cone portion;

an electron gun installed in the neck portion of said funnel; and a deflection yoke installed at the cone portion of said funnel.

18. The color CRT as claimed in claim 17, wherein:

each of the first and second support members comprises a fixed portion which supports one edge of the mask and a flange portion which extends inwardly under the mask from an end portion of the fixed portion, and the correction unit comprises a bar having end portions, each of the end portions being fixed at a corresponding one of the fixed portions of the first and second support members.

19. The color CRT as claimed in claim 17, wherein a thermal expansion coefficient of the correction unit is less than a thermal expansion coefficient of the first and second elastic members.

20. The color CRT as claimed in claim 18, wherein a thermal expansion coefficient of the correction unit is less than a thermal expansion coefficient of the first and second elastic members.

21. A tension mask frame assembly comprising:

a tension mask having slots formed in a first direction and which is supported along edges in a second direction, where tension is applied to said tension mask along the first direction;

a frame which supports said tension mask along the edges in the second direction, said frame comprising an elastic member which applies the tension to said tension mask in the first direction; and a correction unit connected to said frame and which restricts a thermal expansion of said frame in the first direction, wherein:

said correction unit has a thermal expansion coefficient which is less than a thermal expansion coefficient of the elastic member, the elastic member of said frame comprises a pair of prongs extending from a connecting member, said frame further comprises support elements which support said tension mask along the edges in the second direction, and said correction unit extends between and connects the prongs of the elastic member or the support elements of the frames.

22. The tension mask frame assembly of claim 21, wherein:

a relationship between a thermal expansion of the tension mask frame assembly is expressed in an equation as $\Delta Rz = C \times Rz^2$, in which C is a thermal drift correction coefficient of the expansion of the tension mask frame assembly, Rz is a radius of curvature of the edges of said tension mask before thermal expansion of the tension mask frame assembly as measured in a third direction perpendicular to the first and second directions, and $\Delta Rz$ is an amount of change of the radius of curvature in the third direction due to the thermal expansion of the tension mask frame assembly.

23. The tension mask frame assembly of claim 21, wherein said correction unit connects the prongs of the elastic member.

24. The tension mask frame assembly of claim 21, wherein:

said correction unit connects the support elements.

25. The tension mask frame assembly of claim 22, wherein said correction unit connects the prongs of the elastic member.

26. The tension mask frame assembly of claim 22, wherein said correction unit connects the support elements.

27. The tension mask frame assembly of claim 21, wherein said correction unit comprises a bar having an angle cross section.

28. The tension mask frame assembly of claim 27, wherein:

the angle cross section has a bottom side roughly parallel with said tension mask and another side extending in the third direction from the bottom side, the bottom side extends from the another side by a distance W, the another side extends from the bottom side by a distance H, and a ratio of H to W is at or between 21% and 110%.

29. The tension mask frame assembly of claim 28, where the ratio of H to W is 25%.

30. The tension mask frame assembly as claimed in claim 21, wherein said correction unit is disposed between the connecting member and the tension mask so as to define a gap between the correction unit and the connecting member.

31. The tension mask frame assembly as claimed in claim 30, wherein said correction unit connects the prongs of the elastic member so as to define the gap.

32. The tension mask frame assembly as claimed in claim 30, further comprising a support member which is connected to the tension mask, wherein the prongs extend between the connecting member and the support member, and said correction unit connects to the support member so as to define the gap.

33. A tension mask frame assembly comprising:

a tension mask having slots formed in a first direction and which is supported along edges in a second direction, where tension is applied to said tension mask along the first direction;

a frame which supports said tension mask along the edges in the second direction, said frame comprising an elastic member which applies the tension to said tension mask in the first direction and support elements which support said tension mask along the edges in the second direction; and a correction unit connected to said frame and which restricts a thermal expansion of said frame in the first direction, wherein the elastic member of said frame comprises a pair of prongs connected to and extending from a connecting member, and said correction unit comprises a bar which extends between the prongs.

34. The tension mask frame assembly of claim 33, wherein the bar of said correction unit has an angle cross section.

35. The tension mask frame assembly of claim 33, wherein the bar of said correction unit has a changing cross section.

36. The tension mask frame assembly of claim 33, wherein the bar of said correction unit is disposed between the tension mask and the connecting member so as to define a gap therebetween.

* * * * *

UNITED STATES PATENT AND TRADEMARK OFFICE

CERTIFICATE OF CORRECTION

PATENT NO. : 7,005,786 B2
APPLICATION NO. : 10/269075
DATED : February 28, 2006
INVENTOR(S) : Jun-Kyo In et al.

It is certified that error appears in the above-identified patent and that said Letters Patent is hereby corrected as shown below:

Column 15, line 46, change "110%" to --100%--.
Column 17, line 44, change "21%" to --20%--
change "110%" to --100%--.

Signed and Sealed this

Nineteenth Day of September, 2006

JON W. DUDAS
*Director of the United States Patent and Trademark Office*